US009552779B2

(12) United States Patent
Yu et al.

(10) Patent No.: US 9,552,779 B2
(45) Date of Patent: Jan. 24, 2017

(54) ELECTRONIC APPARATUS AND DISPLAY BACKLIGHT CONTROL METHOD

(71) Applicant: Wistron Corporation, New Taipei (TW)

(72) Inventors: Chung-Cheng Yu, New Taipei (TW); Chung-Min Wang, New Taipei (TW); Shang-Yuan Huang, New Taipei (TW); Cheng-Yu Hung, New Taipei (TW); Chien-Chih Cho, New Taipei (TW)

(73) Assignee: Wistron Corporation, New Taipei (TW)

( * ) Notice: Subject to any disclaimer, the term of this patent is extended or adjusted under 35 U.S.C. 154(b) by 1 day.

(21) Appl. No.: 14/644,205

(22) Filed: Mar. 11, 2015

(65) Prior Publication Data

US 2016/0163269 A1 Jun. 9, 2016

(30) Foreign Application Priority Data

Dec. 3, 2014 (TW) ..... 103141962 A

(51) Int. Cl.
*G09G 3/34* (2006.01)

(52) U.S. Cl.
CPC .... *G09G 3/3406* (2013.01); *G09G 2320/0626* (2013.01); *G09G 2330/026* (2013.01); *G09G 2370/04* (2013.01); *G09G 2370/14* (2013.01)

(58) Field of Classification Search
CPC ..... G09G 2360/16; G09G 3/3406; G09G 2320/0233; G09G 2320/0626; G09G 2370/04; B60R 11/0235
See application file for complete search history.

(56) References Cited

U.S. PATENT DOCUMENTS

| | | | | |
|---|---|---|---|---|
| 8,725,917 | B2 | 5/2014 | Tsai et al. | |
| 9,058,761 | B2 * | 6/2015 | Piasecki | G09G 3/04 |
| 9,076,357 | B2 * | 7/2015 | Hussain | H05B 33/0827 |
| 9,262,992 | B2 * | 2/2016 | Sun | G09G 5/10 |

(Continued)

FOREIGN PATENT DOCUMENTS

| | | |
|---|---|---|
| TW | 201214110 | 4/2012 |
| TW | 201241612 | 10/2012 |

OTHER PUBLICATIONS

"Office Action of Taiwan Counterpart Application" with partial English translation, issued on Feb. 25, 2016, p. 1-p. 18, in which the listed references were cited.

*Primary Examiner* — Abbas Abdulselam
(74) *Attorney, Agent, or Firm* — Jianq Chyun IP Office

(57) ABSTRACT

An electronic apparatus and a display backlight control method are provided. The electronic apparatus includes a display, a processing unit, a read-only memory and a backlight controller. The read-only memory stores a basic input output system (BIOS) and a setting table. The setting table includes a plurality of backlight setting values corresponding to each of the displays. When the processing unit executes the BIOS, the processing unit identifies an identifier corresponding to the display connected to the electronic apparatus, so as to obtain the backlight setting values corresponding to the display according to the identifier and the setting table. Then the processing unit provides the backlight setting values to the backlight controller, and the backlight controller controls the backlight power of the display according to the backlight setting values.

10 Claims, 3 Drawing Sheets

(56) References Cited

U.S. PATENT DOCUMENTS

| | | | | |
|---|---|---|---|---|
| 2006/0001641 | A1* | 1/2006 | Degwekar | G09G 3/3406 345/102 |
| 2012/0019492 | A1* | 1/2012 | Barnhoefer | H05B 33/0851 345/207 |

* cited by examiner

ELECTRONIC APPARATUS AND DISPLAY BACKLIGHT CONTROL METHOD

CROSS-REFERENCE TO RELATED APPLICATION

This application claims the priority benefit of Taiwan application serial no. 103141962, filed on Dec. 3, 2014. The entirety of the above-mentioned patent application is hereby incorporated by reference herein and made a part of this specification.

BACKGROUND

Field of the Invention

The invention is directed to a backlight control technique and more particularly, to an electronic apparatus whose setting can be digitalized and a display backlight control method.

Description of Related Art

With development of display technologies, liquid crystal displays (LCDs) have become the mainstream of displays. An LCD panel does not have self-luminance characteristics, and thus, a backlight module is commonly disposed thereunder to provide a light source required by the LCD panel.

Due to the need of the backlight by the display panel, it is a common application to use light-emitting diodes (LEDs) as the backlight for the display panel. Meanwhile, a system circuit of an electronic apparatus also has to be disposed with a power circuit for driving the LED backlight, so as to provide a power supply to enable a backlight module of the display panel. Electrical characteristics, such as the number of LED strings, a current flowing through each LED string or a voltage of each LED string corresponding to the LED backlight module are determined according to the internal structure of the display panel. Thus, as for electronic apparatus, e.g., an all-in-one PC (AIO PC), the design of the backlight power circuit layout is determined by the display panel.

FIG. 1 is a schematic block diagram illustrating an electronic apparatus. An electronic apparatus 100 may adjust backlight settings of a display 130 by using a bill of materials (BOM) 150. For descriptive convenience, only one display 130 is illustrated herein for description. A processor 110 (e.g., a central processing unit (CPU) and/or a platform controller hub (PCH)) of the electronic apparatus 100 may transmit image data to the display 130 for playback through a low voltage differential signaling (LVDS) transmitter 120. As for the setting of backlight power of the display 130, the external circuit may be adjusted through the BOM 150 for a backlight driving integrated circuit (IC) 140, such that backlight setting values required by the corresponding display 130 are adjusted.

However, in a scenario where the electronic apparatus 100 needs two or more displays 130 whose electrical characteristics are not exactly the same, the BOM 150 has to be adjusted and re-designed according to electrical characteristics of the backlight required by each display 130. In other words, if the electronic apparatus 100 is expected to support the connection with various displays 130, while the electrical characteristics of each display 130 are not the same, the design of the BOM 150 becomes more complicated, which causes affection to audit and review processes of the BOM 150 or prolongs the production process of the electronic apparatus during manufacturing. Therefore, how to simplify the design with respect to the flow of setting the backlight module becomes an important subject.

Besides adjusting the electronic apparatus 100 to correspond to different displays 130 by using the BOM 150, the use of the BOM 150 may also be simplified by means of digital setting. With reference to FIG. 2, FIG. 2 is a schematic block diagram illustrating an electronic apparatus. In an electronic apparatus 200, a display controller 220 (e.g., a scalar IC, an embedded controller (EC) or a micro controller unit (MCU)) may receive image data transmitted by the processor 210, convert a signal format of the image data and transmit the image data to a display 230 for playback. Additionally, the display controller 220 may store backlight setting corresponding to the display 230 are stored in a firmware form, such that the display controller 220 may read the backlight settings corresponding to the display 230 after learning the display 230 currently connected to the electronic apparatus 200 and write the backlight settings corresponding to the display 230 into a backlight driving IC 240 by means of, for example, digital communication, such as through an inter integrated circuit (I2C), such that the backlight driving IC 240 may drive the backlight of the display 230 according to the settings.

Nevertheless, as mentioned above, the digital control method illustrated in FIG. 2 relies on the display controller 220 accessing the backlight settings. For the sake of manufacturing cost and system requirements of the electronic apparatus, the display controller 220 cannot be generally configured in each electronic apparatus, and thus, the digital control method cannot be applied in a wide range.

SUMMARY

The invention provides an electronic apparatus and a display backlight control method, capable of achieving digitalized setting of backlight power of each display by means of directly utilizing internal resources of a system, so as to avoid complicated setting with respect to bill of materials (BOM), without incurring additional cost.

According to an embodiment, the invention provides an electronic apparatus. The electronic apparatus includes at least one display, a processing unit, a read-only memory and a backlight controller. The backlight controller is coupled to the at least one display. The processing unit is coupled to the at least one display and the backlight controller. The read-only memory is coupled to the processing unit and stores a basic input output system (BIOS) and a setting table. The setting table includes a plurality of backlight setting values corresponding to each of the at least one display. When the processing unit executes the BIOS, the processing unit identifies an identifier corresponding to each of the at least one display connected to the electronic apparatus, so as to obtain the backlight setting values corresponding to each of the at least one display according to the identifier and the setting table and provides the backlight setting values to the backlight controller by means of digital communication, and the backlight controller controls backlight power of each of the at least one display according to the backlight setting values.

According to another embodiment, the invention provides a display backlight control method adapted for an electronic apparatus including at least one display, a read-only memory and a backlight controller. The display backlight control method includes the following steps. A setting table is provided through the read-only memory, wherein the read-only memory stores a BIOS and the setting table, and the setting table includes a plurality of backlight setting values corresponding to each of the at least one display. When the BIOS is executed, an identifier corresponding to each of the at least one display connected to the electronic apparatus is identified. The backlight setting values corresponding to each of the at least one display are obtained according to the identifier and the setting table, and the backlight setting values are provided to the backlight controller. Backlight power of each of the at least one display is controlled according to the backlight setting values by the backlight controller.

To sum up, in the electronic apparatus and the display backlight control method of provided by the invention, the backlight setting of each display is written into the read-only memory storing the BIOS, and the identifier of each display is identified, such that the backlight setting corresponding to each display is obtained in the setting table of the read-only memory. In this way, the embodiments of the invention can achieve digitalized setting of backlight power of each display by means of directly utilizing the internal resources of the system, instead of relying on any display controller, so as to avoid complicated settings with respect to the BOM without incurring additional cost and achieve wider application.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

According to the embodiments of the invention, an electronic apparatus and a display backlight control method are provided, which are improved based on a digital circuit conception and capable of obtaining a backlight setting corresponding to a display from a setting table of a read-only memory by means of writing the backlight setting corresponding to the display into the read-only memory storing a basic input output system (BIOS) after an identifier of the display is identified. Thereby, digital setting of backlight power of the display can be completely achieved merely by utilizing the internal resources of a system. In order to make the contents of the invention more comprehensible, several embodiments are illustrated for description.

Figure 1:
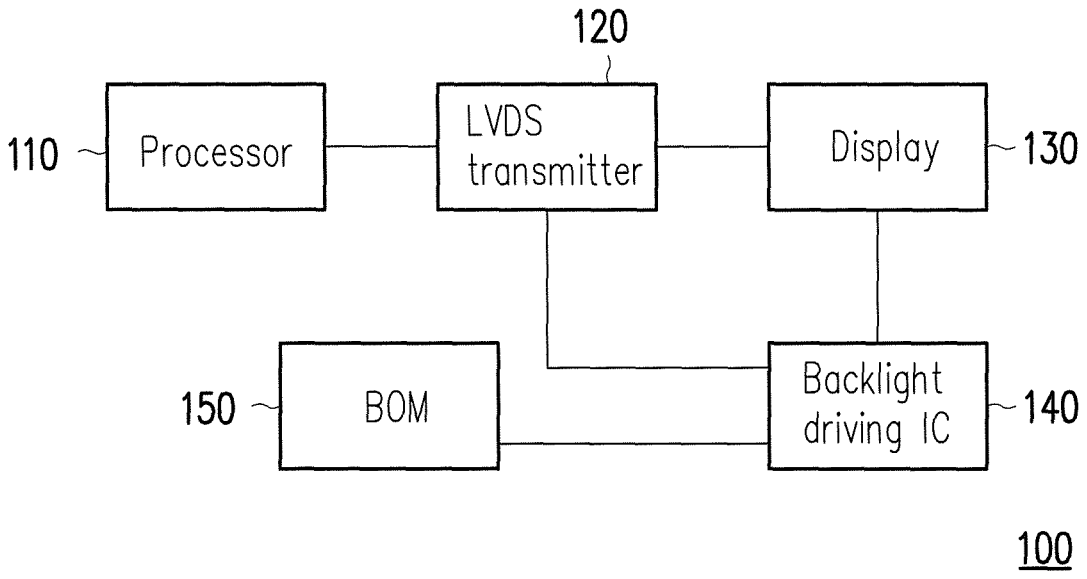
FIG. 1 is a schematic block diagram illustrating an electronic apparatus.
Figure 2:
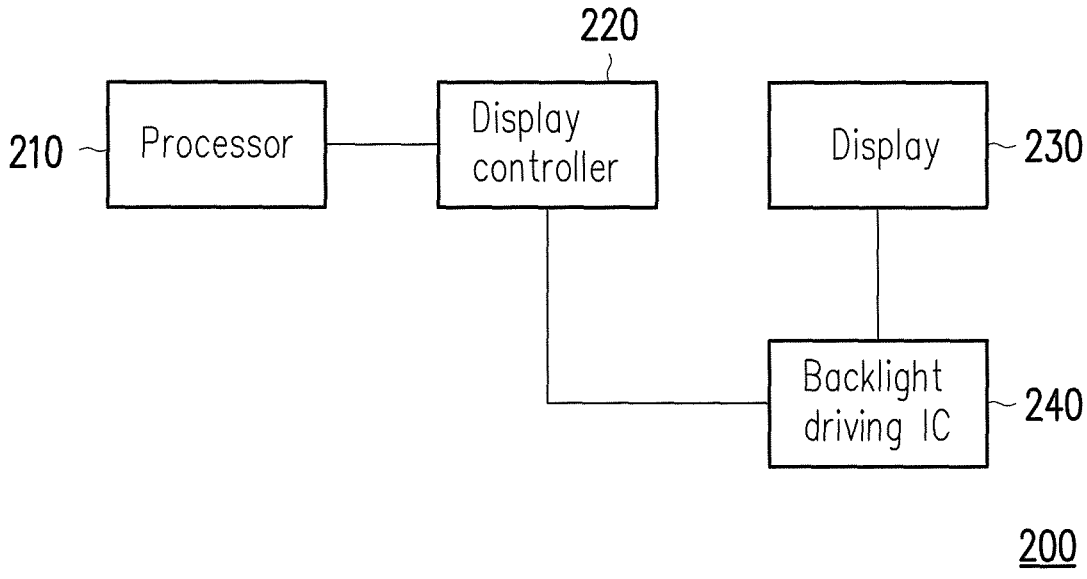
FIG. 2 is a schematic block diagram illustrating an electronic apparatus.
Figure 3:
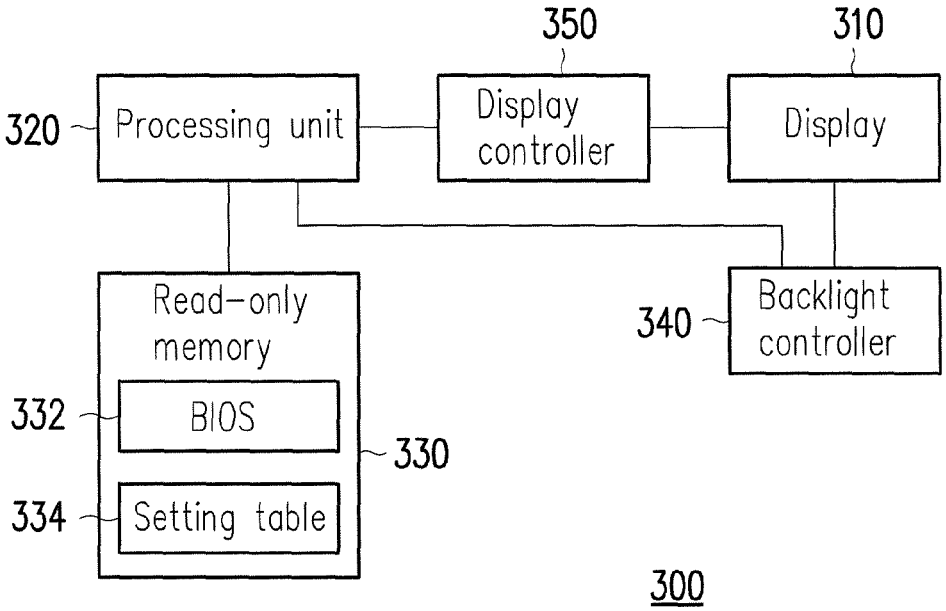
FIG. 3 is a schematic block diagram illustrating an electronic apparatus according to an embodiment of the invention.

FIG. 3 is a schematic block diagram illustrating an electronic apparatus according to an embodiment of the invention. With reference to FIG. 3, an electronic apparatus 300 is, for example, an all-in-one PC (AIO PC). The electronic apparatus 300 includes at least one display (for descriptive convenience, only one display 310 is illustrated in FIG. 3, but the number of the display is not limited in the embodiments of the invention), a processing unit 320, a read-only memory 330, a backlight controller 340 and a display controller 350, which will be respectively described below.

The display 310 is, for example, a liquid crystal display (LCD) display or any other display with no self-luminance characteristics. The display 310 may include a display panel and a backlight module, where the backlight module may include, for example, a light-guide plate and a light source module for providing backlight required by the display panel. The light source module may be formed by, for example, light emitting diodes (LEDs).

The backlight controller 340 may be a backlight driving integrated circuit (IC) capable of writing by means of digital communication, for example. The backlight controller 340 is coupled to the display 310 and configured to drive a power supply of the backlight module of the display 310. The backlight controller 340 includes, for example, a plurality of storage addresses for storing backlight setting values corresponding to the display 310. The storage addresses may be written and stored with the backlight setting values respectively through a system bus interface, such as a system management bus or an inter integrated circuit (I2C) by means of digital communication. The backlight controller 340 adjusts backlight power of the display 310 and performs overcurrent/overvoltage protection on LEDs of the display 310 according to the backlight setting values.

The processing unit 320 is coupled to the display 310 and the backlight controller 340. The processing unit 320 is, for example, a central processing unit (CPU) (e.g., a central processor and/or a platform controller hub (PCH), or any other general-purpose or specific-purpose programmable microprocessor, a digital signal processor (DSP), a programmable controller, an application specific integrated circuit (ASIC), other similar elements, or a combination thereof.

The read-only memory 330 is, for example, a non-volatile random access memory (NVRAM) coupled to the processing unit 320 and configured to store a BIOS 332 and a setting table 334. Therein, the setting table 334 may include a plurality of backlight setting values of the backlight controller 340 corresponding to each display 310, and the backlight setting values may be determined based on electrical characteristics of the backlight module of each display 310. The electrical characteristics of the backlight module of each display 310 include, for example, characteristic parameters, such as the number of LED strings, an operating current and/or an operating voltage. Corresponding to the electrical characteristics of the backlight module, the backlight setting values may be, for example, the number of LED strings that are lit, an operation frequency of the backlight module, and an overcurrent protection mechanism and/or an overvoltage protection mechanism of the backlight module.

The display controller 350 is, for example, a graphics card having a function as, for example, a low-voltage differential signaling (LVDS) transmitter and may transmit image data to the display 310 for playback through an LVDS interface.

Figure 4:
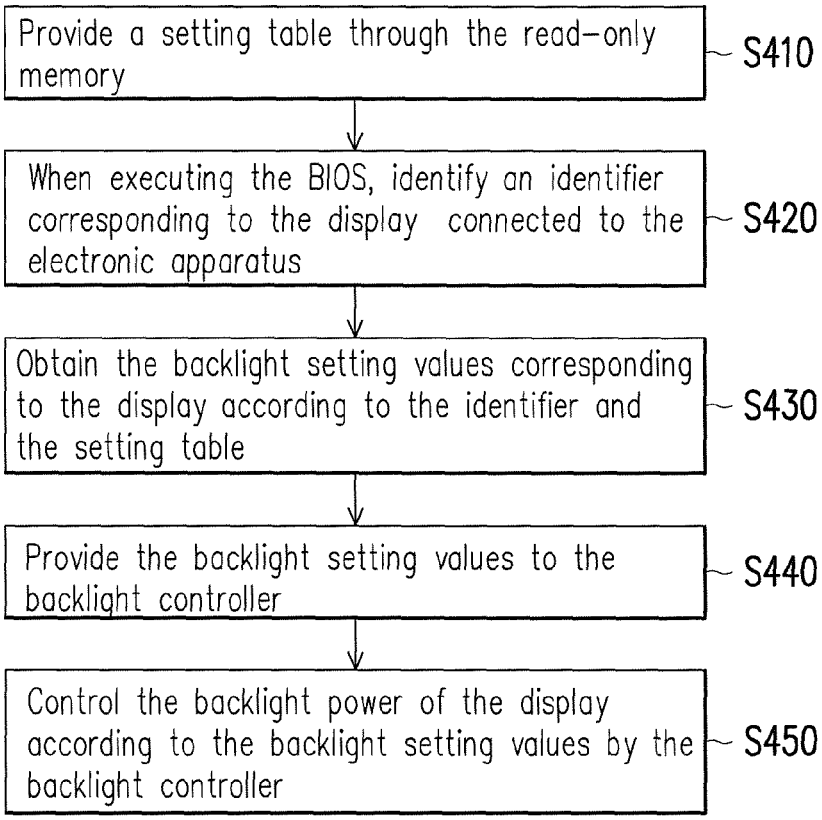
FIG. 4 is a flowchart illustrating a display backlight control method according to an embodiment of the invention.

Based on the system structure described above, a digital display backlight control method provided according to one of the embodiments of the invention will be described below. With reference to FIG. 4, FIG. 4 is a flowchart illustrating a display backlight control method according to an embodiment of the invention, which is adapted for the electronic apparatus 300 illustrated in FIG. 3. Steps of the method will be described in detail with reference to each element illustrated in FIG. 3.

In step S410, the processing unit 320 provides the setting table 334 through the read-only memory 310. Specifically, in an embodiment, before the electronic apparatus 300 is booted (e.g., in the manufacturing stage of the electronic apparatus 300), the setting table 334 may be written into the read-only memory 310 by a developer, such that the backlight setting values corresponding to the display 310 may be stored in the read-only memory 310.

In step S420, when executing the BIOS 332, the processing unit 320 identifies an identifier corresponding to the display 310 connected to the electronic apparatus 300. To be specific, in an embodiment, the display 310 may generate an identification signal corresponding to the identifier of the display 310 when being connected to the electronic apparatus 300. The identifier may correspond to the brand, model or type of the display 310 and be used for selecting the backlight setting values corresponding to the display 310 stored in the read-only memory 310 in the following process. Thus, when the display 310 is connected to the electronic apparatus 300, the electronic apparatus 300 is powered on, and the processing unit 320 executes the BIOS 332 stored in the read-only memory 330 for the boot procedure, the processing unit 320 may receive the identification signal generated by the display 310 through the BIOS 332, so as to determine the identifier corresponding to the display 310, and thereby, the type of the display 310 currently connected with the electronic apparatus 300 may identified.

In step S430, the processing unit 320 obtains the backlight setting values corresponding to the display 310 according to the identifier and the setting table 334. In step S440, the processing unit 320 provides the backlight setting values to the backlight controller 340. In the present embodiment, the processing unit 320 may write the backlight setting values into the backlight controller 340 by means of digital communication through a system bus interface, such as a system management bus, an I2C or the like.

In step S450, the backlight controller 340 controls the backlight power of the display 310 according to the backlight setting values. In an embodiment, the setting values include electrical characteristics of the backlight module of the display 310, such as the number of LED strings, an operating current, an operating voltage and settings with respect to an operation frequency, an overvoltage and/or overcurrent protection mechanism and the like corresponding to the electrical characteristics of the backlight module. The backlight controller 340 may store the backlight setting values written by the processing unit 320 in the storage addresses contained in the backlight controller 340, then, drive the backlight module of the display 310 according to the setting values and perform the overvoltage and/or overcurrent protection mechanism, such that the backlight module of the display 310.

In detail, in an embodiment, the contents of the setting table 334 may respectively correspond to different backlight setting values of the display 310 according to the identifier. Thus, after obtaining the identifier corresponding to the display 310, the processing unit 320 may read the backlight setting values corresponding to the display 310 from the setting table 334 according to the identifier and write the backlight setting values into the backlight controller 340. Then, the backlight controller 340 can control and protect the backlight module of the display 310. Thereby, in the present embodiment, the backlight setting values corresponding to the display 310 are stored in the read-only memory 330 of the BIOS 332 to avoid complicated settings with respect to the BOM and achieve digitalized backlight setting by means of a digital circuit technique, such that the setting process can be simplified. It should be noted that the method is also applicable to a scenario where the electronic apparatus 300 is connected to a plurality of displays 310.

Figure 5:
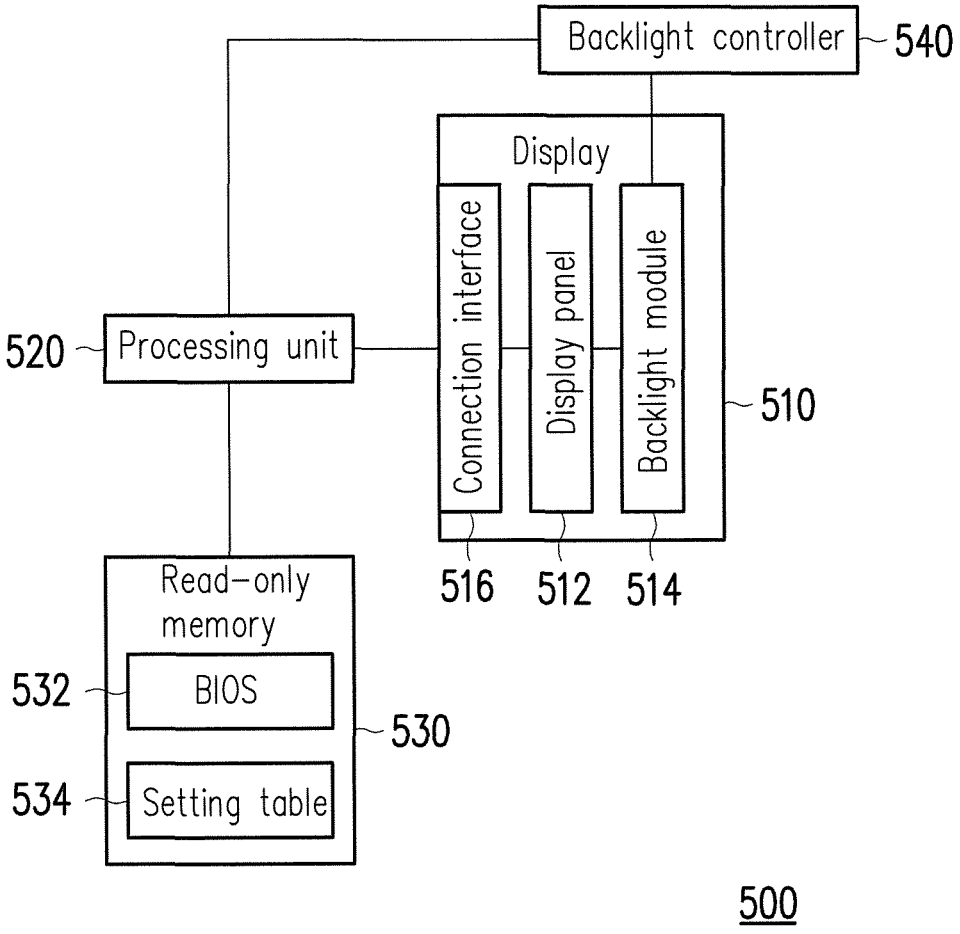
FIG. 5 is a schematic block diagram illustrating an electronic apparatus according to an embodiment of the invention.

An embodiment is provided to further describe such structure for the electronic apparatus. With reference to FIG. 5, FIG. 5 is a schematic block diagram illustrating an electronic apparatus according to an embodiment of the invention. An electronic apparatus 500 includes at least one display 510, a processing unit 520, a read-only memory 530 and a backlight controller 540 containing a backlight driving integrated circuit (IC) structure. The display 510 may include a display panel 512, a backlight module 514 and a connection interface 516, and the read-only memory 530 stores a BIOS 532 and a setting table 534. The display 510, processing unit 520, the read-only memory 530 and the backlight controller 540 of the present embodiment are similar to the display 310, the processing unit 320, the read-only memory 330 and the backlight controller 340 of the embodiment above, and the same parts will not be repeatedly described. For descriptive convenience, the control element (e.g., the display controller 350 illustrated in FIG. 3) is omitted in FIG. 5, and only a display 510 is illustrated.

The connection interface 516 of the display 510 is, for example, a connector and may include an identification pin (ID pin). When the display 510 is connected to the processing unit 520 through the connection interface 516, the display 510 may generate an identification signal which is transmitted through the ID pin of the connection interface 516, and the processing unit 520 may receive the identification signal of the display 510 by means of executing the BIOS 532, so as to obtain and determine the identifier corresponding to the display 510.

Additionally, the backlight controller 540 is, for example, a backlight driving IC configured to drive the backlight module 514 to control backlight power of the display 510. The backlight controller 540 is coupled between the processing unit 520 and each display 510 and capable of receiving backlight setting values corresponding to each display 510 which are provided by the processing unit 520, so as to adjust the backlight power of the display 510 according to the backlight setting values for protection.

It should be noted that in an embodiment, the backlight controller 540 may include a plurality of storage addresses for storing the backlight setting values respectively, and each the storage addresses is, for example, corresponding to a register or any other memory in the backlight controller 540. The processing unit 520 may read the setting table 534 according to the identifier corresponding to the display 510 to obtain the backlight setting values and write the backlight setting values into the storage addresses of the backlight controller 540 respectively by means of digital communication through a system bus interface, such as a system management bus, an I2C or the like. According to setting items respectively corresponding to the storage addresses, after the processing unit 520 respectively writes the backlight setting values corresponding to each display 510 into each corresponding storage address, the backlight controller 540 may adjust the backlight power of the display 510 and perform the overcurrent and/or overvoltage protection according to the setting item corresponding to each storage address and the backlight setting values which are written corresponding to the backlight required by each display 510, such that good backlight control can be achieved by means of digital settings.

An example where a system management bus is used for communication between the processing unit 520 and the backlight controller 540 is provided with reference to the apparatus structure illustrated in FIG. 5 to describe specific embodying manner of the embodiments of the invention.

First, the setting table 534 may be configured in, for example, a firmware form and written into the read-only memory 530 before the electronic apparatus 500 is booted. Therein, contents recorded in the setting table 534 may be adaptively adjusted according to electrical characteristics of the backlight module of each display 510 manufactured by various manufacturers and setting items which may be executed on the backlight for each display 510 by the backlight controller 540.

For example, electrical characteristics of the backlight module 514 of the display 510 of two models are listed in Table 1 below.

TABLE 1

| | Number of LED strings (Strings) | LED current (mA/String) | LED startup voltage (V) |
|---|---|---|---|
| First model | 3 | 120 (Normal) | 34 (Normal) |
| | | 130 (Maximum) | 37 (Maximum) |
| Second model | 2 | 100 (Normal) | 55.8 (Normal) |
| | | 105 (Maximum) | 59.4 (Maximum) |

The contents of the setting table 534 are described by using Table 2. Referring to Table 2, the storage addresses in the backlight controller 540 are respectively corresponding to different backlight setting items. Additionally, the backlight setting values respectively required by the display 510 of the first model and the second model respectively corresponding to the backlight setting items are also listed in Table 2. In other words, the backlight controller 540 controls the display 510 of the first model and the second model according to the backlight setting values, and when the backlight module of each display 510 is abnormal, the abnormality is detected, and a protection mechanism, such as an overcurrent or an overvoltage protection mechanism is activated.

TABLE 2

| Item | Dimming mode, switches of LED strings | Operation frequency, short circuit protection voltage | Maximum current | LED status |
|---|---|---|---|---|
| Storage address | 0x00 | 0x01 | 0x02 | 0x03 |
| First model | 01110001 | 01000011 | 11011010 | 00000000 |
| Second model | 00110001 | 01000011 | 10110101 | 00000000 |

| Item | Digital dimming of LEDs | Overvoltage protection, overcurrent protection | Vender identifier |
|---|---|---|---|
| Storage addresses | 0x04 | 0x05 | 0x06 |
| First model | 00000000 | 11000111 | 00000000 |
| Second model | 00000000 | 01100111 | 00000000 |

It is to be mentioned that the backlight setting values of each backlight setting items in Table 2 respectively represents actual settings. As for the setting item with respect to the dimming mode and an ON/OFF status of each LED string, in an storage address of 0x00, backlight setting value "01110001" indicates an analog dimming mode and that the $234^{th}$ LED string is switched on, and backlight setting value "00110001" indicates an analog dimming mode and that the $12^{th}$ LED string is switched on. As for the backlight setting item with respect to the operation frequency and the short circuit protection voltage, in a storage address of 0x01, backlight setting value "01000011" indicates that the operation frequency is 300 KHz, and the short protection voltage is 8 V. As for the setting item with respect to the maximum current, in a storage address of 0x02, backlight setting value "11011010" indicates an output rate of 74.9% with a current value of 119.8 mA, and backlight setting value "10110101" indicates an output rate of 62.5% with a current value of 100 mA. As for the backlight setting with respect to the LED status, the digital LED dimming and the verder identifier of 0x03, 0x04 and 0x06, backlight setting value "00000000" indicates ready for reading. As for the backlight setting item with respect to the overvoltage protection mechanism and the overcurrent protection mechanism, in a storage address of 0x05, backlight setting value "11000111" indicates that a protection voltage for the overvoltage protection is 48 V, and a size of a protection current for the current protection is 0.5 A, while backlight setting value "01100111" indicates that a protection voltage for the overvoltage protection is 66 V, and a size of a protection current for the current protection is 0.5 A.

Therefore, in the present example, the setting table 534 may include, for example, the storage address information and the backlight setting values respectively corresponding thereto which are respectively contained in the "Storage address", "First model" and "Second model" fields. In other examples, it the storage addresses in the backlight controller 540 configured to store the backlight setting values are already known to the processing unit 520, the storage addresses may be omitted from the setting table 534, and only the backlight setting values corresponding to each display 510 of "First model" and "Second model" are provided in sequence, such that the processing unit 520 determines which address in the backlight controller 540 each backlight setting value is written into. In other words, the contents of the setting table 534 may be adaptively adjusted according to the manner by which the processing unit 520 provides the backlight setting values to the backlight controller 540.

In this way, after identifying the identifier corresponding to each display 510, the processing unit 520 may read the setting table 534 according to the identifier corresponding to the display 510, so as to obtain the backlight setting values corresponding to each display 510. Correspondingly, the processing unit 520 may respectively write the backlight setting values into the storage addresses of the backlight controller 540 through the system management bus, such that the backlight controller 540 controls the backlight module 514 of each display 510 according to actual settings corresponding to the backlight setting values.

As for the identification of the identifier corresponding to the display 510, in the present example, the processing unit 520 may determine the model of the display 510 connected to the electronic apparatus 500 according to the identification signal generated by means of pre-setting the display 510 and the correspondence of the identifier to the display 510.

Specifically, the connection interface 516 of the display 510 may include the ID pin. When the display 510 is connected to the processing unit 520 through the connection interface 516, the display 510 may transmit the identification signal corresponding to the identifier of the display 510 through the identification pin. The processing unit 520 may receive the identification signal through a general purpose I/O (GPI/O) pin (which may be disposed on a PCH, for example) thereof and obtain the identifier corresponding to the display 510 according to the received identification signal. Therein, the identifier corresponding to the display 510 may be set to be identical to the identification signal generated by the ID pin of the display 510. Alternatively, in other embodiments, a conversion relationship may exist between the identifier and the identification signal. Thus, the processing unit 520 may convert the identification signal after receiving the identification signal to obtain the identifier, such that the type and model of the display 510 may be accordingly obtained.

In this way, when the display 510 is connected to the electronic apparatus 500, the processing unit 520 may receive the identification signal generated by the ID pin of the display 510 through the GPI/O pin. The processing unit 520 may obtain the identifier corresponding to the display 510 according to the identification signal received by the GPI/O pin through the BIOS 532.

For example, if the identifier corresponding to each display 510 is set to be identical to the identification signal generated by the ID pin, and the identifier corresponding to the display 510 of the first model is 11100, and that of the second model is 11101, the processing unit 520 may then obtain the identifier of 11100 when receiving an identification signal of 11100 through the GPI/O pin. Meanwhile, when executing the BIOS 532 stored in the read-only memory 530 to perform a pre-extensible firmware interface initialization (PEI) stage of the boot procedure, the processing unit 520 may determine the identifier of 11100, so as to learn that the display currently connected to the electronic apparatus 500 is the display 510 of the first model. In this case, the processing unit 520 may read the setting table 534 according to the identifier 11100 to obtain storage addresses of the backlight controller 540 and a plurality of backlight setting values respectively corresponding thereto, as shown in Table 3 below. Then, the processing unit 520 then respectively writes the backlight setting values into the corresponding storage addresses in the backlight controller 540 through the system management bus, such that the backlight controller 540 may control the backlight power of the display 510 according to the backlight setting items corresponding to each of the storage addresses and the written backlight setting values required by the display 510 of the first model, so as to achieve the digitalized setting of the backlight power.

TABLE 3

| | Storage address | | | |
|---|---|---|---|---|
| | 0x00 | 0x01 | 0x02 | 0x03 |
| Backlight setting value | 01110001 | 01000011 | 11011010 | 00000000 |
| | Storage address | | | |
| | 0x04 | 0x05 | 0x06 | |
| Backlight setting value | 00000000 | 11000111 | 00000000 | |

It should be noted that in other embodiments, the processing unit 520 may also read the setting table 534 from the read-only memory 530 when the electronic apparatus 500 is in a non-booting operation stage by means of adaptive read authority configuration. In this way, even the status of the electronic apparatus 500 being connected to another display 510 is changed during the operation stage, the processing unit 520 may still obtain the corresponding backlight settings according to the identifier corresponding to the display 510, so as to adaptively adjust the backlight power of each display 510 and provide good backlight control.

To summarize, in the electronic apparatus and the display backlight control method provided by the embodiments of the invention, the backlight settings of each display is written into the read-only memory storing the BIOS, and the identifier of each display is designed as corresponding to the identification signal generated by the ID pin of the display. Thereby, the identifier can be determined to learn the model or the type of each display, such that the backlight settings corresponding to each display can be obtained according to the setting table stored in the read-only memory, and the backlight settings can be written into the backlight controller by means of digital communication, such as through the system management bus.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electronic apparatus, comprising:

a display, connected to the electronic apparatus;

a backlight controller, coupled to the connected display;

a processing unit, coupled to the connected display and the backlight controller; and a read-only memory, coupled to the processing unit and storing a basic input output system (BIOS) and a setting table, wherein the setting table comprises a plurality of sets of backlight setting values and a plurality of identifiers of a plurality of displays, wherein each of the sets of backlight setting values corresponds to different one of the plurality of identifiers of the plurality of displays, wherein when the processing unit executes the BIOS, the processing unit identifies an identifier of the connected display, wherein the processing unit obtains a set of backlight setting values corresponding to the connected display by reading the setting table according to the identifier of the connected display, wherein the obtained set of backlight setting values corresponds to an identifier matching the identifier of the connected display, wherein the processing unit provides the obtained set of backlight setting values to the backlight controller, and the backlight controller controls backlight power of the connected display according to the obtained set of backlight setting values.

2. The electronic apparatus according to claim 1, wherein the processing unit writes the obtained set of backlight setting values into the backlight controller through a system bus interface.

3. The electronic apparatus according to claim 2, wherein the backlight controller further comprises a plurality of storage addresses for storing the obtained set of backlight setting values, the processing unit reads the setting table according to the identifier of the connected display to obtain the set of backlight setting values for the connected display and respectively writes the obtained set of backlight setting values into the storage addresses of the backlight controller through the system bus interface.

4. The electronic apparatus according to claim 1, wherein the connected display is further connected to the processing unit through a connection interface and generates an identification signal, and the processing unit determines the identifier of the connected display according to the identification signal through the BIOS.

5. The electronic apparatus according to claim 4, wherein the connection interface further comprises an identification pin (ID pin) configured to transmit the identification signal, and the processing unit receives the identification signal through a general purpose I/O (GPI/O) pin, so as to obtain the identifier of the connected display.

6. A display backlight control method, adapted for an electronic apparatus comprising a display connecting to the electronic apparatus, a read-only memory and a backlight controller, the display backlight control method comprising:

providing a setting table through the read-only memory, wherein the read-only memory stores a BIOS and the setting table, and the setting table comprises a plurality of sets of backlight setting values and a plurality of identifiers of a plurality of displays, wherein each of the sets of backlight setting values corresponds to different one of the plurality of identifiers of the plurality of displays;

when the BIOS is executed, identifying an identifier of the connected display;

obtaining a set of backlight setting values corresponding to the connected display by reading the setting table according to the identifier of the connected display, wherein the obtained set of backlight setting values corresponds to an identifier matching the identifier of the connected display, and providing the obtained set of backlight setting values to the backlight controller; and controlling backlight power of the connected display according to the obtained set of backlight setting values by the backlight controller.

7. The display backlight control method according to claim 6, wherein the step of providing the obtained set of backlight setting values to the backlight controller comprises:

writing the obtained set of backlight setting values into the backlight controller through a system bus interface.

8. The display backlight control method according to claim 7, wherein the backlight controller further comprises a plurality of storage addresses for storing the obtained set of backlight setting values, and the step of providing the obtained set of backlight setting values to the backlight controller further comprises:

respectively writing the obtained set of backlight setting values into the storage addresses of the backlight controller through the system bus interface.

9. The display backlight control method according to claim 6, wherein the connected display is further connected to the processing unit through a connection interface, and the step of identifying the identifier of the connected display when the BIOS is executed comprises:

receiving an identification signal generated by the connected display connected to the processing unit through the connection interface; and determining the identifier of the connected display according to the identification signal through the BIOS.

10. The display backlight control method according to claim 9, wherein the connection interface further comprises an ID pin configured to transmit the identification signal, and the step of identifying the identifier of the connected display connected to the electronic apparatus when the BIOS is executed comprises:

receiving the identification signal through a GPI/O pin, so as to obtain the identifier of the connected display.

* * * * *